United States Patent [19]

Zevuluni et al.

[11] Patent Number: 4,781,101

[45] Date of Patent: Nov. 1, 1988

[54] MOBILE MANEUVERABLE CROWD CONTROL SHIELD

[76] Inventors: Daniel Zevuluni, 1 Zunz Street; Michael Vinicky, 12 Merkaz Baley Melacha, both of Tel Aviv, Israel

[21] Appl. No.: 75,766

[22] Filed: Jul. 20, 1987

[30] Foreign Application Priority Data

Jul. 27, 1986 [IL] Israel ..... 79527

[51] Int. Cl.[4] ..... F41H 5/14

[52] U.S. Cl. ..... 89/36.09; 109/49.5; 280/755

[58] Field of Search ..... 89/36.07, 36.09; 109/1 R, 1 S, 9, 49.5; 280/47.16, 293, 755

[56] References Cited

U.S. PATENT DOCUMENTS

| | | | |
|---|---|---|---|
| 1,083,846 | 1/1914 | Markson | 89/36.07 |
| 1,247,457 | 11/1917 | Seabrook | 89/36.09 |
| 1,253,964 | 1/1918 | Hack | 89/36.09 |
| 1,299,620 | 4/1919 | Roy | 89/36.09 |
| 1,327,326 | 1/1920 | Howland | 89/36.09 |
| 2,370,596 | 2/1945 | Wallace | 89/36.09 |
| 2,909,377 | 10/1959 | Ulinski | 280/755 |
| 3,401,952 | 9/1968 | Johanson et al. | 280/755 |
| 4,192,216 | 3/1980 | Wait | 89/40.03 |

FOREIGN PATENT DOCUMENTS

| | | | |
|---|---|---|---|
| 118335 | 8/1918 | United Kingdom | 89/36.09 |

OTHER PUBLICATIONS

Scientific American, "A Bullet-Proof Stretcher", Aug. 14, 1915, p. 144.

*Primary Examiner*—Stephen C. Bentley

*Attorney, Agent, or Firm*—Dennison, Meserole, Pollack & Scheiner

[57] ABSTRACT

A mobile hand-maneuverable security post consisting of a protective shield about the height of a person, said shield comprising a roof and at least one porthole, said shield being mounted on a mobile platform comprising two rear wheels and one front wheel, said platform further comprising stabilizing means adapted to prevent toppling of the shield under normal use.

7 Claims, 2 Drawing Sheets

MOBILE MANEUVERABLE CROWD CONTROL SHIELD

The present invention concerns a mobile security post, specifically a hand-maneuverable security post.

All over the world, security forces, especially police, are confronted with the problem of controlling crowds and demonstrations which at times can become violent. The means that these security forces have at their disposal generally comprise helmets, billy sticks and hand-held protective shields. In addition, mounted police on horseback are often used to control crowds. The above means have not been found satisfactory when crowds become very large or exceedingly agressive and throw objects, such as bottles and stones, at the security forces. Moreover, since the security forces are mostly on foot, a large determined mob can frequently overwhelm them and knock them to the ground.

The object of the present invention is therefore to provide security forces with means for controlling crowds and demonstrators when these turn into mobs. A further object of this invention is to provide security forces with the means for readily approaching and dismantling suspicious objects, such as explosive devices.

In accordance with the present invention, there is provided a mobile maneuverable security post consisting of a protective shield about the height of a person, said shield comprising a roof and at least one porthole, wherein said shield is mounted on a mobile platform comprising two rear wheels and one front wheel, said platform further comprising stabilizing means adapted to prevent toppling of the shield under normal use.

In order to better understand the invention, there are provided the following drawings wherein.

Figure 1:
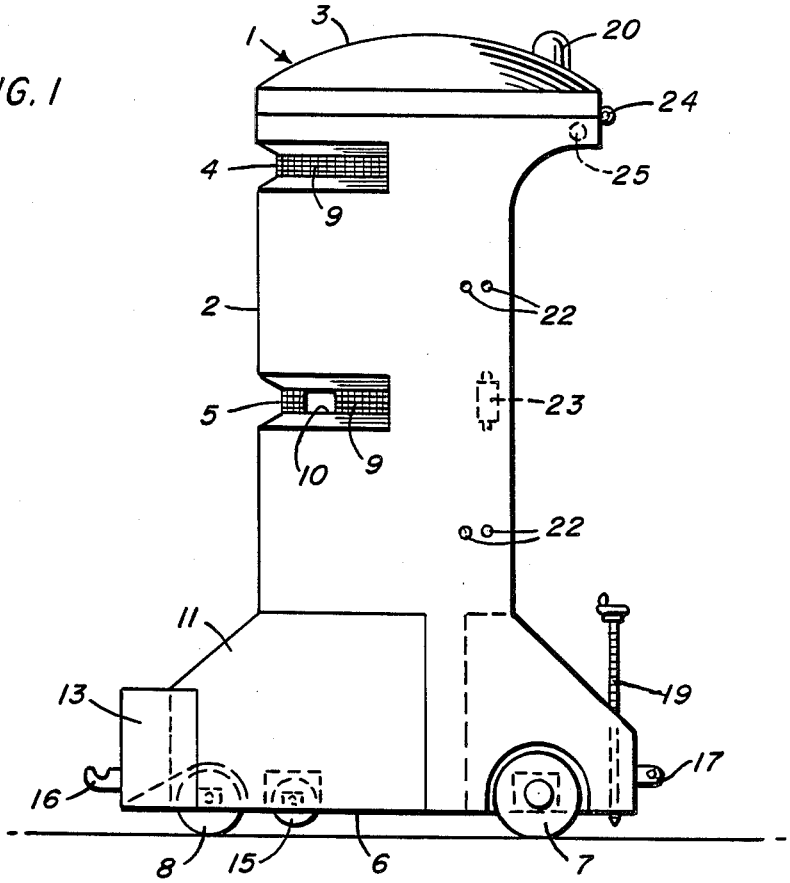
FIG. 1 is a side view of the security post.
Figure 2:
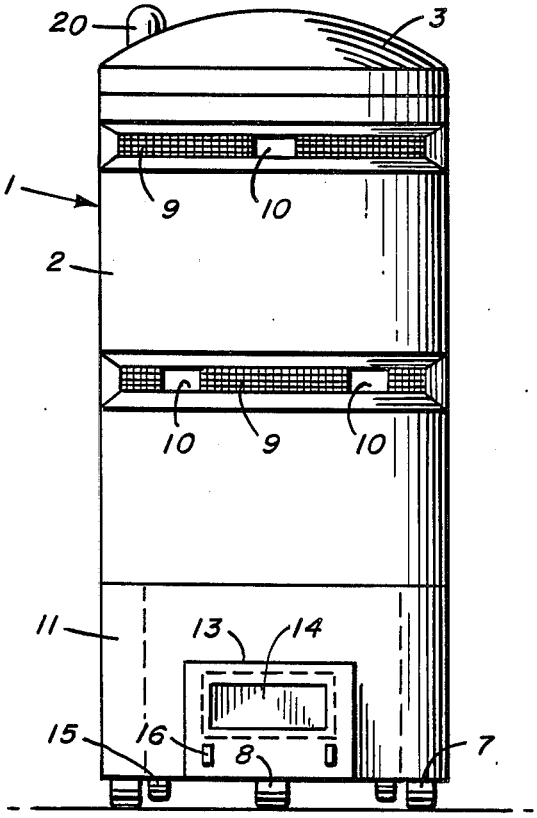
FIG. 2 is a front view thereof.
Figure 3:
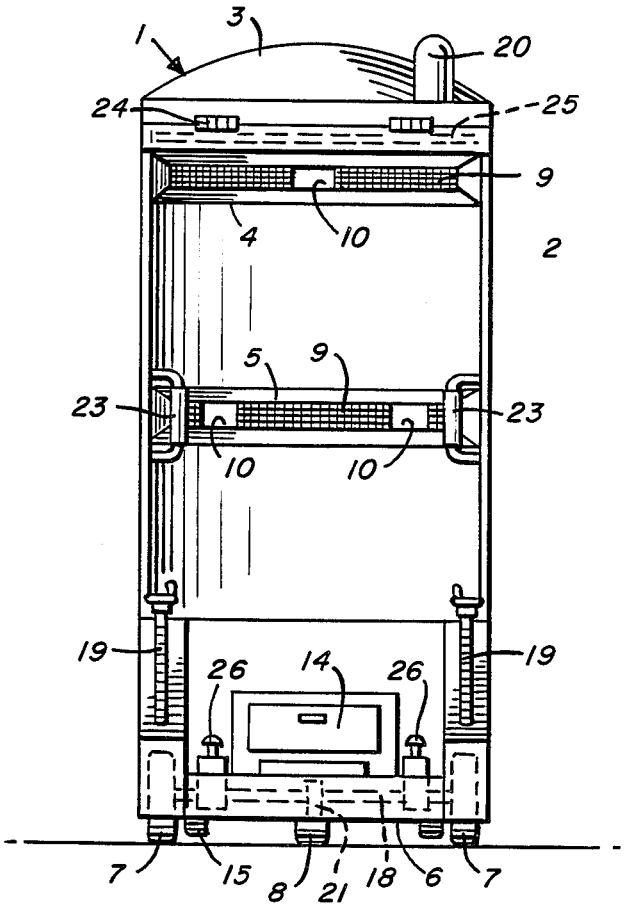
FIG. 3 is a rear view thereof.
Figure 4:
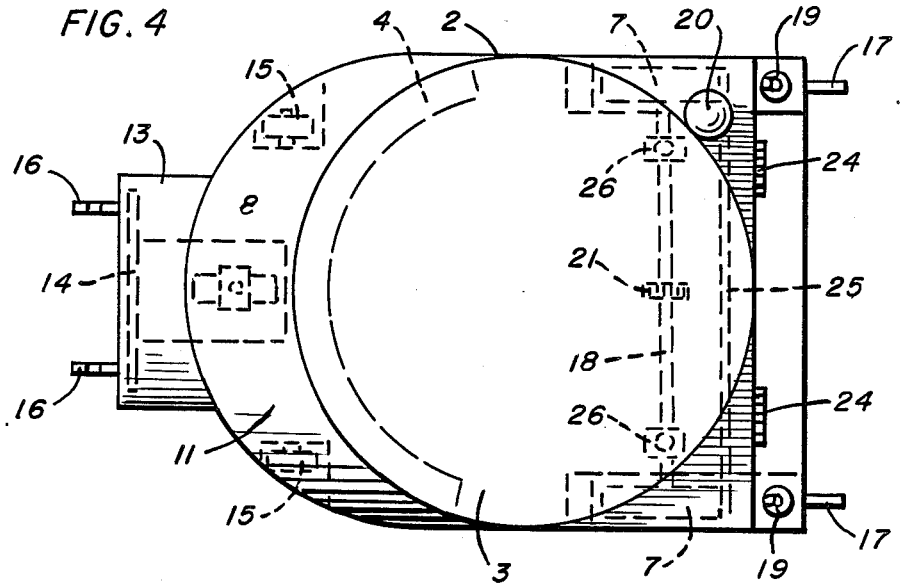
FIG. 4 is a top view thereof.

Referring now to FIGS. 1–4, these show the security post, designated generally as 1, about 60 mm. wide and 180 mm. high, comprising a curved shield 2 and domed roof 3. Portholes 4 and 5 are situated near the front of the shield. The shield 2 is mounted on a platform 6 having two relatively large rear wheels 7 and a smaller single front wheel 8. The portholes 4 and 5 are recessed into the interior of the shield for better protection from flying objects. These portholes are covered from the inside with perforated metal sheets or screens 9 through which a security person can see over a wide range. Small windows 10 (see FIG. 2) are constructed in the portholes 4 to enable the placing of a firearm therethrough if necessary. These windows 10 can be opened and closed from the inside with sliding or hinged shutters (not shown). Towards its lower end, the shield 2 tapers near its front 11 and back 12 in the form of a trapezoid and terminates at its lower end near the platform 6, to which it is attached by welding or other means. At the lower front end of the tapered part of the shield 11 there is provided a box-shaped extension 13 which has a trapdoor 14 (see FIG. 2) which can be opened and closed from the inside. When open, a security person can maneuver implements through the opening of this extension in front of the security post, for example to remove suspicious objects. Two small stabilizing wheels 15 are provided near the front of the platform 6, elevated slightly above the front and rear wheels, to stabilize the security post from toppling over, since the post is basically supported on the ground by only three wheels. Towing hooks 16 and 17 are provided at the front and rear of the security post respectively. The rear wheels 7 are mounted on the sides of the platform 6 within the shield 2 and they are connected by an axle 18. These wheels have no side directional movement. The front wheel 8 is self-pivoting.

Stabilizing wheels 15 provide support for the security post 1 when it tilts slightly to one side or another, particularly when in motion, but generally these stabilizing wheels are off the ground. To stop the security post from moving, brakes 26 are provided, which tighten around axle 18. A mechanical screw jack 19 is provided near the rear of the platform, whose function it is to anchor the security post when in a stationary position so that it cannot be readily moved. This is accomplished by turning the screw rod of jack 19 into the ground or into a hollow tube hammered into the ground for this purpose. On the roof there is fixed a battery operated revolving spotlight 20 for use when operating the security post at night. The rear axle 18 connecting the two rear wheels 7 can also be provided with a toothed gear 21 for engaging with any low-powered drive motor, so that the security post can become self-propelled. On the sides of the shield 2 there are provided holes 22 through which two adjacent security posts can be bolted together. Suitable bolts can be stored near the holes 22 in appropriate brackets. In such a manner a protective wall can be formed to any length desired.

The security post is used in the following manner:

A security person stands behind the security post 1, holding on to the push handles 23 mounted near the inside edges of the shield 2 and propels the shield forward either by walking behind it or by placing one foot on the platform 6 and pedalling with the other foot. This way he can view the scene in front of him via the portholes 4, when standing, or 5 when bending down. The security post can turn readily because of the self-pivoting forward wheel 8 and it can also climb up and down curbs because of the difference in height from the ground because wheels 7, 8 and 15 and the distances from front to stabilizing to rear wheels. The roof 3 of the security post protects the security person from objects thrown from overhead, such as from windows, roofs etc. This roof 3 is attached to the shield 2 by means of hinges 24 which enable it to be raised or lowered as desired. A metal rod 25 is secured below the roof of the shield 2 to enable a security person standing on the platform to hold on to the rod 25, thereby steadying himself.

The security post of this invention can be made of sheet metal about 3–5 mm. thick or from fibreglass reinforced polyester or other shielding material and is generally lightweight and easily pushed by a single person. The security post described herein is quite suitable for controlling mobs and large crowds and offers protection for the security person behind the shield, as well as for other people not involved in belligerent activity standing behind such a security post. Furthermore, the security post offers flexibility to law enforcing agencies in that it enables such forces to mount frontal attacks against mobs with minimum manpower and a great deal of mobility. In addition to using such a security post individually, such posts may be hooked up together to form a chain of mobile security and defense posts which can be propelled forward into a crowd. Such chains of security posts can be used in numerous ways, such as in straight lines, "V" formations etc. The light weight of the security posts compared to armoured vehicles, and their ease of coupling and decoupling to one another, make their use very flexible and effective, particularly in urban areas. The security post of this invention can of course be utilized for military and anti-terrorist activities as well.

We claim:

1. A mobile hand-maneuverable crowd control protective shield of a height to accommodate a standing person therein, said shield comprising continuous front and side wall portions and a roof, said side wall portions defining an open back for said shield rearward of said front wall portion, a platform mounting said shield, said platform including one pivotally mounted front steering wheel, two laterally spaced rear wheels rearward of said front wheel and defining a common support plane with said front wheel, and stabilizing wheel means slightly above the support plane for stabilizing said shield against excess lateral tipping and for facilitating forward movement of the shield over varying ground elevations through selective engagement therewith, said stabilizing wheel means being mounted on said platform between said front and rear wheels and closer to said front wheels than said rear wheels.

2. The crowd control shield of claim 1 wherein said rear wheels are mounted on a common fixed axis extending transversely between the side wall portions, said stabilizing wheel means comprising a pair of laterally spaced stabilizing wheels mounted on an axis parallel to the axis of the rear wheels, said rear wheels rotating in laterally spaced parallel planes, said stabilizing wheels rotating in laterally spaced parallel planes parallel to the planes of the rear wheels.

3. The crowd control protective shield of claim 2 including a transversely elongate viewing port across a major extent of said front wall portion for wide angle viewing, said viewing port being recessed rearwardly relative to said front wall portion and into the interior of the shield, said viewing port being defined by upper and lower spaced coextensive horizontal panels rigid with and rearwardly converging from said front wall portion and terminating in a vertical protective screen.

4. The crowd control shield of claim 3 including a second viewing port duplicating the first mentioned viewing port and being vertically spaced therefrom.

5. The crowd control shield of claim 4 including means on the side wall portions of the shield for engagement with side wall portions of duplicate shields positioned in side-to-side relation therewith to define a common forwardly directed wall.

6. The crowd control shield of claim 4 wherein the front wall portion of said shield includes a forwardly directed extension thereon immediately above the platform, said extension including a selectively openable door manipulable from the interior of the shield.

7. The crowd control shield of claim 3 wherein said elongate viewing port includes at least one access opening therein.

* * * * *